US012066260B2

(12) United States Patent
Bellitti et al.

(10) Patent No.: US 12,066,260 B2
(45) Date of Patent: Aug. 20, 2024

(54) MODULAR FIREARM CONTROL UNIT

(71) Applicant: Amend2, LLC, Idaho City, ID (US)

(72) Inventors: Matthew Bellitti, Idaho Falls, ID (US); Austin Damoth, Idaho Falls, ID (US); Nathan Dudney, Idaho Falls, ID (US); Mark Hillis, Idaho Falls, ID (US)

(73) Assignee: Amend2, LLC, Idaho Falls, ID (US)

( * ) Notice: Subject to any disclaimer, the term of this patent is extended or adjusted under 35 U.S.C. 154(b) by 0 days.

(21) Appl. No.: 17/849,428

(22) Filed: Jun. 24, 2022

(65) Prior Publication Data

US 2023/0137635 A1 May 4, 2023

Related U.S. Application Data

(60) Provisional application No. 63/214,610, filed on Jun. 24, 2021.

(51) Int. Cl.
*F41A 11/02* (2006.01)

(52) U.S. Cl.
CPC ..... *F41A 11/02* (2013.01)

(58) Field of Classification Search
CPC ..... F41A 11/00; F41A 11/02
USPC ..... 42/106, 71.02, 72, 73
See application file for complete search history.

(56) References Cited

U.S. PATENT DOCUMENTS

| | | | | |
|---|---|---|---|---|
| 6,401,379 | B1 * | 6/2002 | Moon | F41C 23/18 42/71.01 |
| 10,429,143 | B2 * | 10/2019 | Zajk | F41C 3/00 |
| 11,385,011 | B2 * | 7/2022 | Lee | F41A 19/12 |
| 2006/0156607 | A1 * | 7/2006 | Curry | F41A 19/15 42/69.01 |
| 2009/0071053 | A1 * | 3/2009 | Thomele | F41A 11/02 42/70.08 |
| 2017/0321980 | A1 * | 11/2017 | Wolf | F41A 11/02 |
| 2019/0204033 | A1 * | 7/2019 | Fellows | F41A 3/66 |
| 2021/0071977 | A1 * | 3/2021 | Lee | F41A 19/10 |
| 2022/0290939 | A1 * | 9/2022 | Lee | F41A 17/46 |

* cited by examiner

*Primary Examiner* — John Cooper
(74) *Attorney, Agent, or Firm* — Travis Banta; Loyal IP Law, PLLC

(57) ABSTRACT

The present disclosure relates to a modular firearm control unit that aid in making compatible a slide associated with a first firearm and a frame associated with a second firearm. The compatibility made functional using a frame that includes an aperture and a rigid insert that includes a slide rail and an aperture that is compatible with the aperture found in the frame.

20 Claims, 4 Drawing Sheets

MODULAR FIREARM CONTROL UNIT

BACKGROUND

The first firearms use began in the 14$^{th}$ century and essentially were small enough cannons to be held by a man. These firearms required a match, spark, or ember light a flash pan that held primer powder to be able to fire these primitive firearms. In time, a matchlock mechanism was developed which lowered a match to the flash pan of the firearm when a trigger was pulled. This allowed the user to hold and aim a gun while waiting for it to fire. Even though the matchlock mechanism allowed the user to aim the firearm, an external fire source to light the matchlock was still necessary to ignite gunpowder when the trigger was pulled. The flintlock mechanism improved upon the matchlock because the flintlock mechanism created a spark, on demand, when the trigger was pulled to ignite the primer powder in the flash pan. The problem with the flintlock mechanism is that the mechanism often misfired in inclement weather and failed to ignite wet powder making the reliability of firearms with a flintlock mechanism questionable. This prompted the creation of a percussion cap. Percussion caps contained a dry mixture of chemicals which were explosively sensitive to shock (e.g., from a falling hammer on a firearm) and allowed a user to fire reliable regardless of the weather. Percussion caps, containing a shock-sensitive explosive, ignited upon the impact of a hammer that was released when the trigger was pulled which allowed fire created by the explosion to ignite gunpowder within the firearm and fire a bullet.

As firearms improved so did the ammunition used with the firearms. Ammunition like that used in a cannon was round (e.g., a ball) and advanced from stone to iron and later to lead. Cannon balls were installed in a barrel and rammed into a seated position on top of gunpowder in the cannon, or on a wad between the gunpowder and the cannon ball. These cannon balls were wildly inaccurate because of an unpredictable spin that occurred when the cannon balls were fired. Firearms of the era were also "smoothbore" (e.g., lacking grooves) which caused unpredictable spin on a lead ball or cannon ball. To improve accuracy, helical rifle grooves were machined into the inside of barrels in both cannons and firearms. Machining these grooves was called rifling and was not initially popular because rifling made rifle cleaning a substantially more difficult task. Refinements in gunpowder technology and the development of ammunition cartridges increased the popularity of rifled barrels because shooters benefited from the accuracy improvements while also reducing the work associated with cleaning a firearm barrel.

The development of an ammunition cartridge, which contained all the components necessary to fire a projectile from a firearm in one object, revolutionized firearms technology. Ammunition cartridges include a metallic case, preferably brass, fitted to accept a primer, gunpowder, and a projectile. More commonly, an ammunition cartridge is referred to as a "bullet" even though the projectile, the bullet, is but one element of an ammunition cartridge. One of the reasons for this clarification is that ammunition cartridges are made in different sizes. The sizes are often labeled by the diameter of the bullet also referred to as a caliber. Caliber was originally used to define the diameter of a barrel bore and now it is often used to describe bullets corresponding to the bore diameter. For example, a brass case may be a particular size, provide a primer pocket for receiving a primer of a particular size, have an internal volume of a specific size to receive gun powder, and may further accept a bullet of a particular caliber typically measured in tenths or thousandths of an inch in the United States and using metric diameter measurements in countries that use metric measurements.

The development of ammunition cartridges further improved the moving of ammunition into a chamber of a firearm and the speed of firing. Two devices were created to hold ammunition in a usable position within a firearm, a clip, and a magazine. A clip groups ammunition cartridges together, but has no moving parts. Firearms that use clips contain mechanisms to move the ammunition cartridge from the clip and inserts the round into a firing position in the chamber. The magazine, often mistakenly identified as a clip, aids in not only storing rounds but also moving the round into firing position by use of spring tension pushing magazines towards a top of the magazines. The dimensions of magazines depend on many ammunition cartridge and firearm characteristics, including the caliber of bullet, the length of the firearm frame, the angle of magazine port, the number of ammunition rounds, the firearm retrieval site, the type of bolt or slide, the size and shape of the magazine port, the weight preferences, and etc. The dimensional specifications of magazines make modularity extremely difficult in that a magazine designed for a particular firearm will only operate within that particular firearm model. Any seemingly minor change in the dimensions of a magazine from one model to another renders such magazine useless to any other firearm model even if it contains ammunition of the same caliber.

To accommodate for different dimensional specifications for magazines, firearms manufacturers have created different models of firearms that are designed for shooters with different grip preferences or hand sizes. For example, a user may prefer a wider grip, while another likes a longer grip, another may wish to conceal a handgun and desire a smaller grip profile, while others may desire a magazine that holds a desired number of ammunition cartridges. All of these alterations change the dimension of the firearm magazine and in so doing changes the mechanisms for receiving the cartridges stored in the magazine.

To further explain using an automatic pistol, a pistol can be grouped into two major parts an upper portion referred to herein as an upper or slide portion and a lower or frame portion. In some embodiments, the slide portion may include parts such as a slide, barrel, guide rod, recoil spring, firing pin, ammunition receiving port, receiver rail, and ammunition ejector port and others that are all appropriately sized for a certain caliber of ammunition. In some embodiments, the frame portion may include trigger group, grip, magazine receiver port, magazine, magazine ejector button, ejector button, connector rail, disassembly pin, and lever which are largely sized for function and comfort independent of caliber, with the exception of the magazine and magazine receiver port in this example. Both the slide portion and frame portions are interconnected and interrelated. A receiver rail in the frame and a connector rail in the slide must both be aligned, or a slider portion cannot connect with a frame portion. If a slide removal pin is not aligned correctly, the pistol cannot be taken apart (field stripped) to allow for a more thorough cleaning. A trigger assembly in the frame portion does not work if it does not interact with the firing pin in the slide portion. Finally, the ammunition feed port where a magazine offloads a bullet into a receiving chamber of the firearm cannot function properly if not aligned correctly. In other words, if a magazine is not precisely positioned within a firearm, the firearm will not successfully load an ammunition cartridge to be fired. Further, magazines with dimensional specifications that include even very minor differences cannot be used in a firearm for which the magazine is not intended because ammunition cartridges will not properly exit the ammunition feed port in the magazine into the chamber of the firearm due to misalignment of the magazine and the firearm. Any of these misalignments may not only keep the pistol from firing properly but may also cause misfires or cause ammunition cartridges to detonate at an improper location putting both the user and any bystanders in mortal danger.

It is therefore on object of the disclosure to provide an improved fire control unit which reduces the number of parts required to operate a firearm. It is another object of this disclosure to provide a fire control unit that correctly meets all caliber specific dimensions for a particular firearm. It is another object of this disclosure to provide a fire control unit which is easily removable from a grip or frame of a firearm. It is another object of this disclosure to provide a fire control unit that functionally corresponds with a slide of a firearm.

SUMMARY OF THE DISCLOSURE

Disclosed herein is a modular firearm control unit that allows the lower portion of a first firearm to become compatible with an upper portion of a second firearm that are not normally compatible while providing satisfactory operation of the firearm.

Further disclosed herein is a rigid insert of a modular firearm control unit. The rigid insert of the modular firearm control unit includes a first set of slide rails and an aperture. The aperture is compatible with a frame aperture.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure provides novel modular firearm frames which may be used with various types of firearms including semi-automatic pistols, modern sporting rifles, automatic rifles, semi-automatic rifles, and other firearms.

In the following description of the disclosure, reference is made to the accompanying drawings, which form a part hereof, and in which is shown by way of illustration specific implementations in which the disclosure is may be practiced. It is understood that other implementations may be utilized, and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are displayed or described in another embodiment or figure. In other words, elements in the figures may be interchangeable between various embodiments disclosed herein, whether shown or not.

Figure 1:
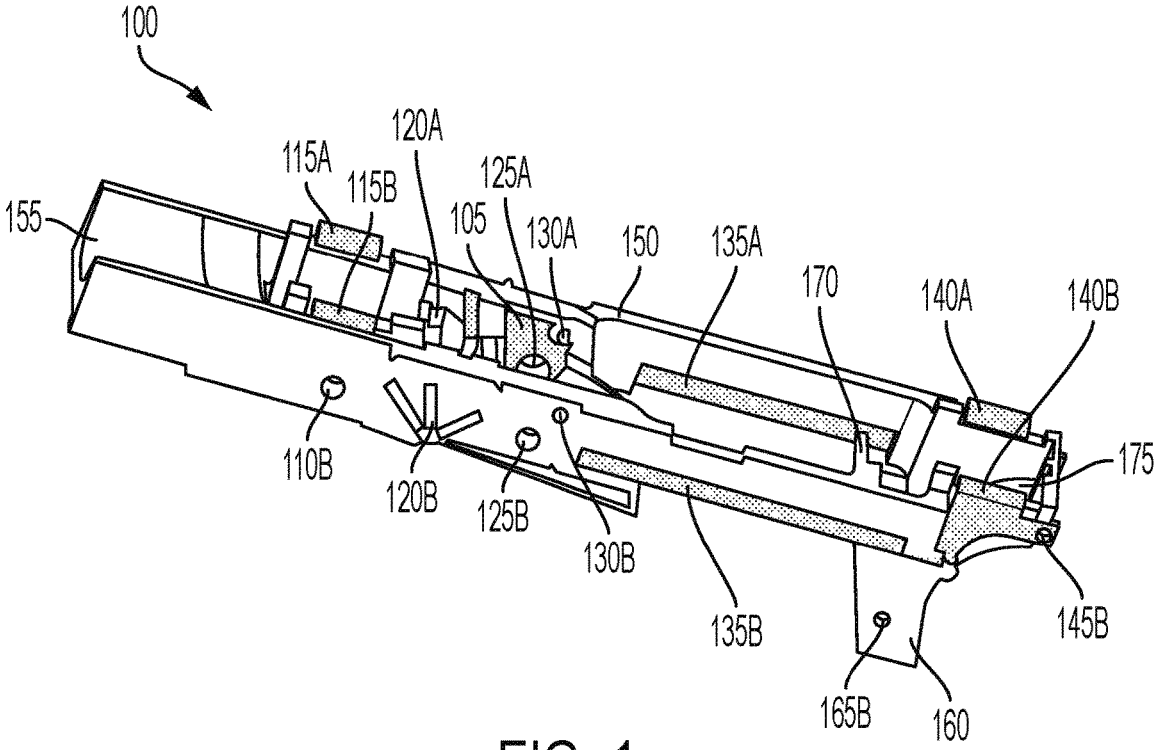
FIG. 1 illustrates a left-sided perspective view of an embodiment of a modular firearm control unit.

FIG. 1 illustrates a left-side view of a modular firearm control unit 100. Modular firearm control unit 100 includes frame 150 that may incorporate rigid insert 105. Frame 150 may envelop rigid insert 105 integrating then rigid insert into the modular frame (e.g., an over mold of rigid insert 105 into frame 150). Frame 150 may be made of various combination of materials that may include metal (i.e., steel, bronze, copper, tin, zinc, metals, metal alloys, and the like according to particular applications), thermoplastics (i.e., polyamide polyphthalamide, polyphenylene sulfide, polyetheretherketones and other polymers) or other synthetic or natural materials. Further a portion of rigid insert 105 may be exposed and interact with a firearm slide and/or the lower portion of a firearm. Rigid insert 105 may also be manufactured using various materials and combinations of synthetic or natural materials and need not be specifically metal. Moreover, rigid insert 105 may be more rigid than frame 150 though it is possible that both frame 150 and rigid insert 105 may be composed of the same materials. Rigid insert 105 may include distal slide rails 115A and 115B that may extend upward from the main part of the frame and may further include bend towards the outside of frame 150. Alternatively, distal slide rails 115A and 115B may include different bends in one or more directions to accommodate a slide or an upper portion of a firearm. Rigid insert 105 may include proximal slide rails 140A and 140B that may extend upward from the main part of the frame and may further include a bend towards the outside of frame 150. Alternatively, proximal slide rails 140A and 140B may include different bends in one or more directions to accommodate a slide or an upper portion of a firearm. Below distal slide rails 115A and 115B is located distal pin apertures 110A shown in FIG. 2 because of view angle) and 110B. Distal pin apertures 110A and 110B may be used in accommodate a pin. This pin may be an internal pin not extending to the outside of a firearm. Runners 135A and 135B may be connected to a lower plate not enveloped by frame 150. Further, this plate may extend proximally and include proximal apertures 145A and 145B that may be included to reduce weight or may be used to receive a pin connecting the modular firearm control unit 100 to a portion of a firearm.

Rigid insert 105 may include runners 135A and 135B that are located closer to the proximal end of rigid insert 105 than the distal end of rigid insert 105. Runners 135A and 135B may include distinct shapes and sizes. For instance, runner 135B may include a notch where runner 135A may not. Further runners 135A and 135B may be partially exposed, or rather, not completely enveloped by frame 150. Alternatively, runners 135A and 135B may be completely enveloped in frame 150 such that no portion of runners 135A and 135B are exposed.

Modular firearm control unit 100 may further include slide stop slots 120A and 120B. Slide stop slots 120A and 120B extend through both frame 150 and rigid insert 105. Slide stop slots 120A and 120B are positioned to accommodate a slide stop that may extend from the left side of frame 150 to the right side of frame 150. Modular firearm control unit 100 may also include housing apertures 125A and 125B positioned to accommodate a trigger housing pin. The trigger housing pin may extend from a right side of frame 150 through the right and left side of rigid insert 105 and then through the left side of frame 150. Locking block pin aperture 130A and 130B are located above and proximally to housing pin aperture 125A and 125B are positioned to receive a housing pin. Frame 150 includes an aperture on both the left and the right side of the frame 150 allowing a housing pin to extend from one side of frame 150 to another.

Frame 150 may further include trigger housing aperture 165 that is located on a trigger mechanism housing 160 which is a downward extending portion of frame 150. trigger housing aperture 165 may open on a right side of frame 150 and a left side of frame 150 to accommodate a pin that would run perpendicularly to the length of frame 150. Frame 150 further includes recoil spring housing 155 that may include a curved bottom sized to accommodate a recoil spring from a firearm. Distal plate 170 sections off the distal portion of the trigger mechanism housing. Further, distal plate 170 may be shaped to follow the angle of the distal portion of the trigger mechanism housing. At the same time, proximal plate 175 sections off the proximal portion of the trigger mechanism housing 160 and follows the curvature of the proximal portion of the trigger mechanism housing.

Each firearm intrinsically has advantages and disadvantages. The firearm control unit is intended to exploit the advantages of two different firearms not normally compatible. For example, the firearm control unit may be used as an intermediary between an upper portion of a first firearm (e.g., a slide) and a lower portion of a second firearm (e.g., a grip module), creating a single functional firearm from different models, for example, of firearms. Non-serialized parts may be further provided as aftermarket parts so that a slide from a first firearm may be connectable to the disclosed firearm control unit, which may be connectable to grip modules with different features, such as being smaller for concealment, tactical for attaching lights, or sighting equipment by use of picatinny rails, or handles that are larger for more comfortable shooting, for example. Further, the firearm control unit modifies and consolidates individual parts found in the lower and or upper portion of the different firearms to create the firearm control unit. The firearm control unit renders unnecessary one or more parts in a particular firearm model for ease and convenience of use while also making replacement of other parts, such as trigger components, a simple matter. Combining parts to create a firearm control unit not only creates stability but also allows a user to have a single unit that is easily stored, located, installed, and modified by other modular parts provided by aftermarket manufacturers. As a result, the firearm control unit is able to exploit advantages of two different firearms (or aftermarket parts), not normally compatible with the firearm as originally manufactured, to be used together in a single functional firearm.

Figure 2:
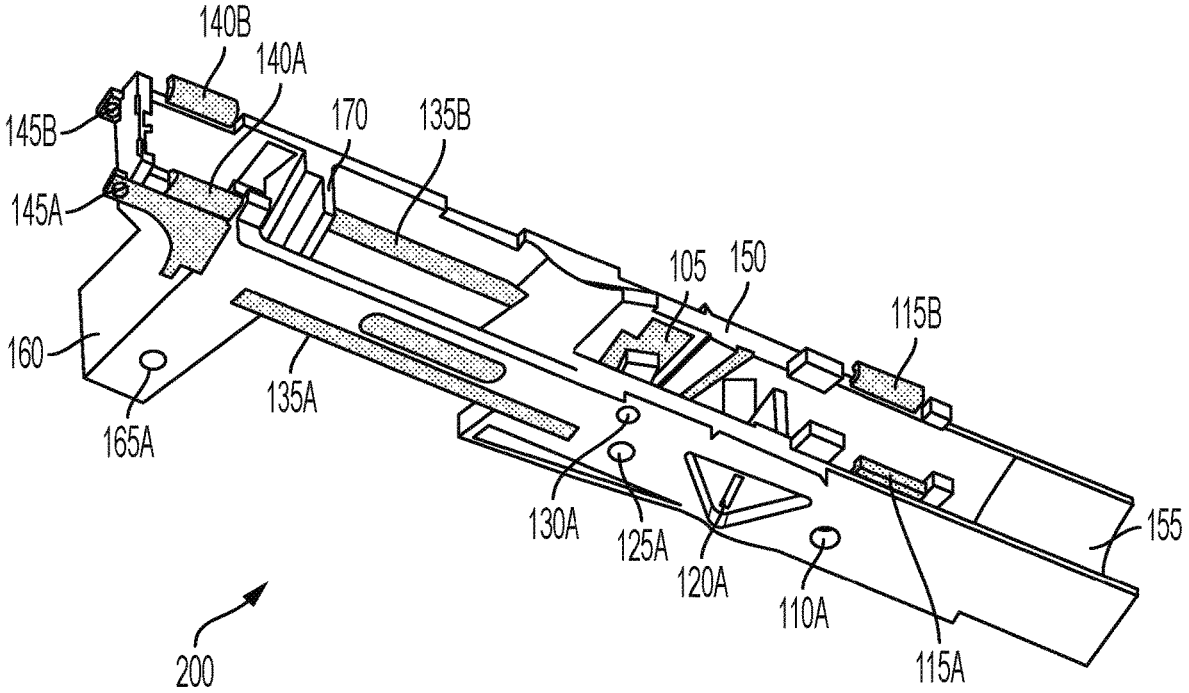
FIG. 2 illustrates a right-sided perspective view of an embodiment of a modular firearm control unit.

FIG. 2 illustrates a right-side view of a modular firearm control unit 200 which is similar in many cases to modular firearm control unit 100, shown in FIG. 1. Modular firearm control unit 200 includes frame 150 that may incorporate rigid insert 105. Frame 150 may envelop rigid insert 105 integrating then rigid insert into the modular frame (e.g., an overmold of rigid insert 105 into frame 150). Frame 150 may be made of various combination of materials that may include metal (i.e., steel, bronze, copper, tin, zinc, metals, metal alloys, and the like according to particular applications), thermoplastics (i.e., polyamide polyphthalamide, polyphenylene sulfide, polyetheretherketones and other polymers) or other synthetic or natural materials. Further a portion of rigid insert 105 may be exposed and interact with the slide and/or the lower portion of a firearm. Rigid insert 105 may also be manufactured using various materials and combinations of synthetic or natural materials and need not be specifically metal. Moreover, rigid insert 105 may be more rigid than frame 150 though it is possible that both frame 150 and rigid insert 105 may be composed of the same materials. Rigid insert 105 may include distal slide rails 115A and 115B that may extend upward from the main part of the frame and may further include bend towards the outside of frame 150. Alternatively, distal slide rails 115A and 115B may include different bends in one or more directions to accommodate a slide or an upper portion of a firearm. Rigid insert 105 may include proximal slide rails 140A and 140B that may extend upward from the main part of the frame and may further include a bend towards the outside of frame 150. Alternatively, proximal slide rails 140A and 140B may include different bends in one or more directions to accommodate a slide or an upper portion of a firearm. Below distal slide rails 115A and 115B are located distal pin apertures 110A and 110B (shown in FIG. 1, due to the angle of view of FIG. 2). Distal pin apertures 110A and 110B may be used to accommodate a pin disposed between distal pin apertures 110A and 110B. This pin may be an internal pin not extending to the outside of a firearm. Runners 135A and 135B may be connected to a lower plate of rigid insert 105 not enveloped by frame 150. Further this plate may extend proximally and include proximal apertures 145A and 145B that may be included to reduce weight or may be used to receive a pin connecting the modular firearm control unit 200 to a portion of a firearm.

Rigid insert 105 may include runners 135A and 135B that are located closer to the proximal end of rigid insert 105 than the distal end of rigid insert 105. Runners 135A and 135B may include distinct shapes and sizes. For instance, runner 135B may include a notch where runner 135A may not. Additionally, runners 135A may include a position for a firearm serial number located an outside portion of the flat surface of one of runners 135A, as required by the United States Bureau of Alcohol, Tobacco, Firearm, and Explosives. Alternatively, runners 135A and 135B may be identically shaped. One or more portions of runners 135A and 135B may be exposed. Alternatively, runners 135A and 135B may be completely enveloped in frame 150 such that no portion of runners 135A and 135B are exposed.

Modular firearm control unit 200 may further include slide stop slots 120A and 120B. Both frame 150 and rigid insert 105 may include slide stop slots 120A and 120B.

Further, slide stop slots 120A and 120B may be positioned to accommodate a slide stop that may extend from the left side of frame 150 to the right side of frame 150. Modular firearm control unit 200 may also include trigger housing apertures 125A and 125B positioned to accommodate a trigger housing pin. The trigger housing pin may extend from a right side of frame 150 through the right and left side of rigid insert 105 and then through the left side of frame 150 requiring housing apertures 125 on both the left and the right sides. Locking block pin aperture 130A and 130B (130B shown in FIG. 1) are located above and proximally to housing pin aperture 125A and 125B are positioned to receive a housing pin. Frame 150 includes an aperture on both the left and the right side of the frame 150 allowing a housing pin to extend from one side of frame 150 to another.

Frame 150 may further include trigger housing aperture 165 that is located on a trigger mechanism housing 160 which is a downward extending portion of frame 150. trigger housing aperture 165 may open on a right side of frame 150 and a left side of frame 150 to accommodate a pin that runs perpendicularly to the length of frame 150. Frame 150 further includes recoil spring housing 155 that may include a curved bottom sized to accommodate a recoil spring from a firearm. Distal plate 170 sections off the distal portion of the trigger mechanism housing and follows the angle of the distal portion of the trigger mechanism housing. At the same time, proximal plate 175 sections off the proximal portion of the trigger mechanism housing and follows the curvature of the proximal portion of the trigger mechanism housing.

Figure 3:
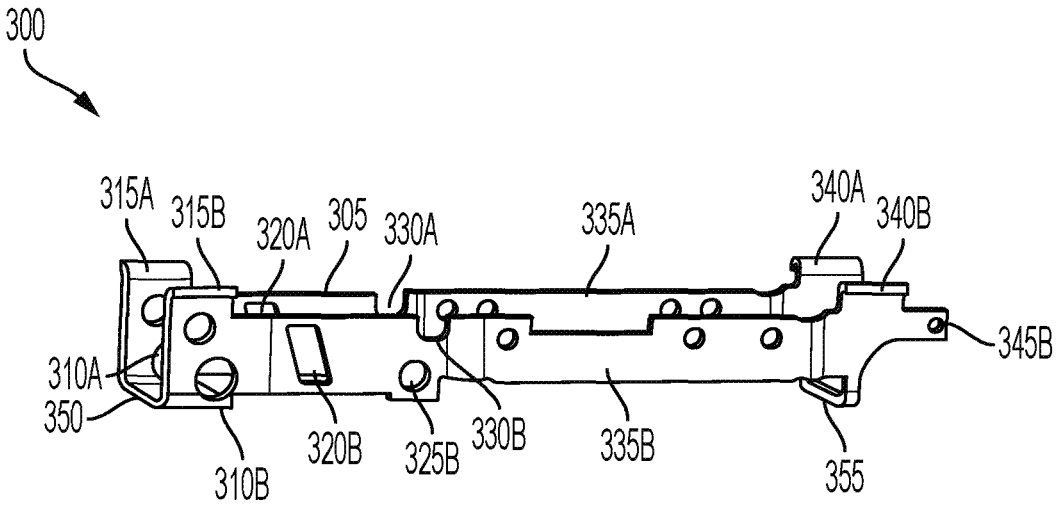
FIG. 3 illustrates a left-sided view of an embodiment of a rigid insert for a modular firearm control unit.

FIG. 3 illustrates a left-sided view 300 of an embodiment of rigid insert 305 for a modular firearm control unit (shown in part as rigid insert 105 in FIGS. 1 and 2 due to over molding). Rigid insert 305 may be comprised of a right side and a left side and may include distal cross brace 350 and proximal cross brace 355 to provide stability between the left and right side of rigid insert 305 which may be necessary to maintain structural cohesion when forces from firing a projectile are applied to frame 150 in FIG. 1 and FIG. 2, for example). Distal cross brace 350 may be located below distal slide rails 315A and 315B while proximal cross brace 355 may be located proximal slide rails 340A and 340B. Distal slide rails 315A and 315B may extend upward from the main part of the frame and may further bend towards the outside of frame 150. Alternatively, distal slide rails 115A and 115B may include different bends in one or more directions to accommodate a slide or an upper portion of a firearm. Rigid insert 305 may include proximal slide rails 340A and 340B that may extend upward from the main part of the frame and may bend towards the outside of frame 150 (not depicted in FIG. 3). In an alternative embodiment, proximal slide rails 340A and 340B may include different bends in one or more directions to accommodate a slide or an upper portion of a firearm.

Other apertures in rigid insert 305 include distal pin apertures 310A and 310B that may be located above distal cross brace 350 and below distal slide rails 315A and 315B. Distal pin apertures 310A and 310B may accommodate a pin. This pin may be an internal pin and therefore may not extend to the outside of a firearm. Proximally to distal pin apertures 310A and 310B are slide stop slots 320A and 320B. Slide stop slots 320A and 320B are positioned to accommodate a slide stop that may extend from the left side of rigid insert 305 to the right side of rigid insert 305. Proximally to slide stop slots 320A and 320B are trigger housing apertures 325A and 325B. Housing pin apertures 325A and 325B are located on both the right and left sides of rigid insert 305 respectively (325A being hidden from view due to perspective). Above housing pin apertures 325A and 325B are locking block notches 330A and 330B. Locking block notches 330A and 330B correspond with locking block apertures 130A and 130B (not shown in FIG. 3). Further, locking block notches 330A and 330B may be located on both the right and left sides of rigid insert 305.

Rigid insert 305 may include runners 335A and 335B that are located proximally to, locking block notches 330A and 330B. Runners 335A and 335B may include distinct shapes and sizes. For instance, runner 135B may include a notch where runner 135A may not. Additionally, runner 135A may include serial number located an outside portion of the flat surface of one of runners 135A, as required by the United States Bureau of Alcohol, Tobacco, Firearm, and Explosives. Alternatively, runners 335A and 335B may be identically shaped. One or more portions of runners 335A and 335B may be exposed. Alternatively, runners 335A and 335B may be completely enveloped in Frame 150 (shown in FIG. 1 and FIG. 2) such that no portion of runners 335A and 335B are exposed. Runners 335A and 335B may include apertures to aid in attaching rigid insert 305 to frame 150 (shown in FIG. 1 and FIG. 2) and may also be used to reduce the overall weight of modular firearm control unit 100 (shown and discussed above with respect to FIG. 1 and FIG. 2). Near the most proximal portion of rigid insert 305 proximal apertures 345A and 345B may be included to accommodate a pin to further secure modular firearm control unit to a firearm (not depicted in its entirety).

Figure 4:
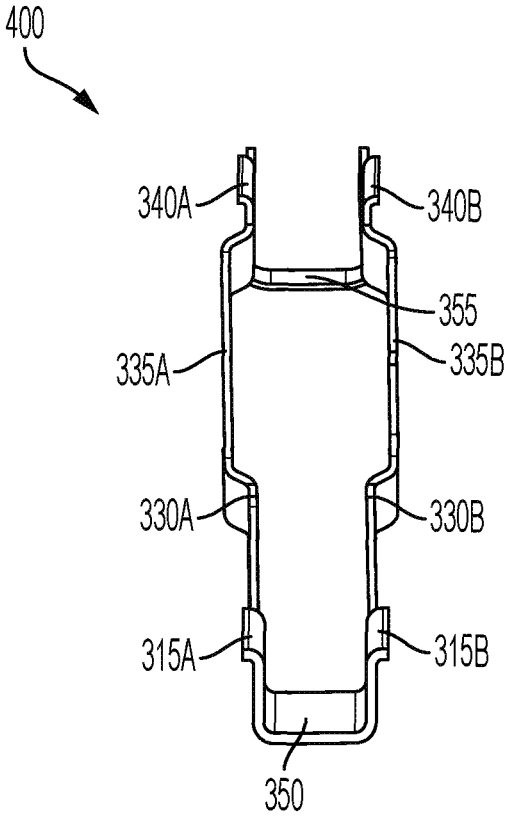
FIG. 4 illustrates a top perspective view of an embodiment of a rigid insert for modular firearm control unit.

FIG. 4 illustrates a top perspective view 400 of an embodiment of a rigid insert 105 for modular firearm control unit 100 (shown, for example, in FIG. 1, above). Rigid insert 105 may include a right side and a left side and may include distal cross brace 350 and proximal cross brace 355 to provide stability between the left and right side of rigid insert 305. Distal cross brace 350 may be located below distal slide rails 315A and 315B while proximal cross brace 355 may be located below proximal slide rails 340A and 340B.

Distal cross brace 350 may extend towards the proximal end the same distance as distal slide rails 315A and 315B. At the same time, distal slide rails 340A and 340B may extend proximally more than proximal cross brace 355 to accommodate the curvature of the trigger mechanism housing 160 (shown in FIG. 1, above). In an alternative embodiment the sizes on the two bridges may vary or may include additional connections between the left and right sides for strength, rigidity, or functional reasons. Locking block notches 330A and 330B are located proximally to distal slide rails 315A and 315B and distally to runners 335A and 335B. Locking block notches 330A and 330B corresponds with locking block pin apertures 130A and 130B (shown in FIG. 1). Further, locking block notches 330A and 330B may be located on both the right and left sides of rigid insert 305. Runners 335A and 335B are located distally to proximal slide rails 340A and 340B and both the right and the left runners 335A and 335B bends outward on the distal end then bends inward on the proximal end. These bends allow the modular control unit 100 (as shown in FIG. 1) to properly mate with one or more components of another firearm.

Proximal slide rails 340 may be located distally to runners 335A and 335B. Proximal slide rails 340 are located to be able to accommodate a slide of a firearm (not shown). Proximal slide rails 340A and 340B that may extend upward from the main part of the frame and may further include bend towards the outside of frame 150 (shown in FIG. 1). Alternatively, proximal slide rails 340A and 340B may include different bends in one or more directions to accommodate a slide or an upper portion of a firearm. Runners 335A and 335B may be connected to a lower plate not enveloped by frame 150 (shown in FIG. 1, for example).

Figure 5:
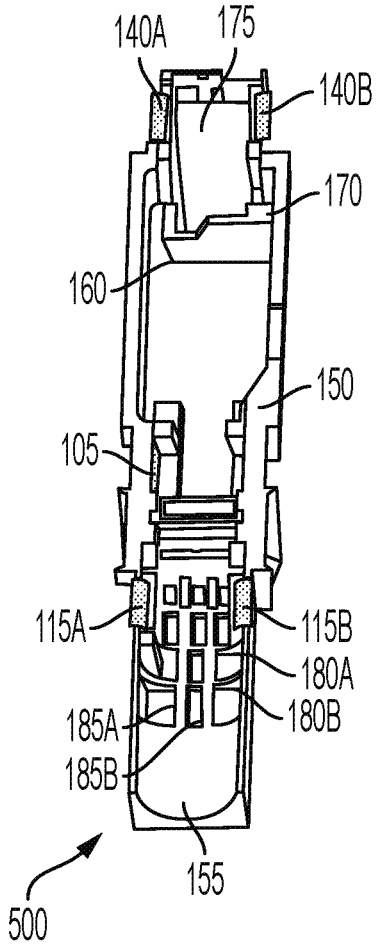
FIG. 5 illustrates a top perspective view of an embodiment of modular firearm control unit.

FIG. 5 illustrates a top perspective view of an embodiment of modular firearm control unit 500. Frame 150 may envelop rigid insert 105 integrating then rigid insert 105 into the modular frame. Frame 150 may be made of various combination of materials that may include metal (i.e., steel, bronze, copper, tin, zinc, metals, metal alloys, and the like according to particular applications), thermoplastics (i.e., polyamide polyphthalamide, polyphenylene sulfide, polyetheretherketones and other polymers) or other synthetic or natural materials. Further a portion of rigid insert 105 may be exposed and interact with the slied and/or the lower portion of a firearm. Rigid insert 105 may also be composed using various materials and combinations of synthetic or natural materials and need not be specifically metal. Moreover, rigid insert 105 may be more rigid than frame 150 though it is possible that both frame 150 and rigid insert 105 may be composed of the same materials. Rigid insert 105 may include distal slide rails 115A and 115B that may extend upward from the main part of the frame and may further include bend towards the outside of frame 150. Alternatively, distal slide rails 115A and 115B may include different bends in one or more directions to accommodate a slide or an upper portion of a firearm. Rigid insert 105 may include proximal slide rails 140A and 140B that may extend upward from the main part of the frame and may further include a bend towards the outside of frame 150. Alternatively, distal slide rails 115A and 115B may include different bends in one or more directions to accommodate a slide or an upper portion of a firearm. Below distal slide rails 115A and 115B is located distal pin apertures 110A (as shown in FIG. 1) and 110B (as shown in FIG. 1). Distal pin apertures 110A and 110B may be used in accommodate a pin. This pin may be an internal pin not extending to the outside of a firearm. Runners 135A and 135B may be connected to a lower plate not enveloped by frame 150. Further, this plate may extend proximally and include proximal apertures 145A and 145B that may be included to reduce weight or may be used to receive a pin connecting the modular firearm control unit 100 to a portion of a firearm.

Frame 150 further includes recoil spring housing 155 that may include a concave arcuate shaped bottom sized to accommodate a recoil spring from a firearm (e.g., having a profile that is opposite of a cylinder or a tapered cylinder). Recoil spring housing 155 may further include ribs 180A and 180B and stringers 185A and 185B. Ribs 180A and 180B may be shaped as a concave arcuate profile and run orthogonally to the length of frame 150. Stringers 185A and 185B, alternatively, may run parallel to the length of frame 150. Exemplary ribs 180A and 180B and stringers 185A and 185B may provide a structural framework without adding weight and may include a single or a plurality of ribs 180A and 108B and stringers 185A and 185B. In an alternative embodiment, recoil spring housing 155 may be shaped in a solid inverted arch without ribs 180A and 180B and stringers 185A and 180B. Distal plate 170 sections off the distal portion of the trigger mechanism housing 160 and follows the angle of the distal portion of the trigger mechanism housing 160. At the same time, proximal plate 175 sections off the proximal portion of the trigger mechanism housing 160 and follows the curvature of the proximal portion of the trigger mechanism housing 160.

Figure 6:
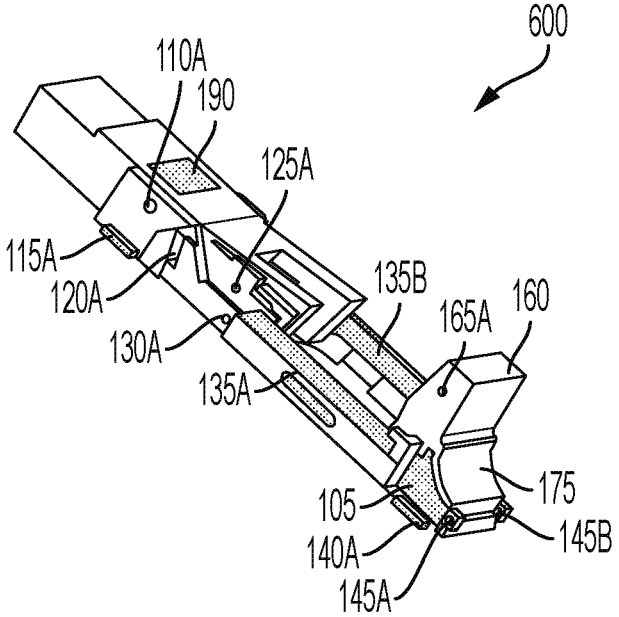
FIG. 6 illustrates a bottom perspective view of an embodiment of modular firearm control unit.

FIG. 6 illustrates a bottom perspective view of an embodiment of modular firearm control unit 600. Frame 150 may envelop at least portions of rigid insert 105 integrating rigid insert 105 into the modular frame. Frame 150 may be made of various combination of materials that may include metal (i.e., steel, bronze, copper, tin, zinc, metals, metal alloys, and the like according to particular applications), thermoplastics (i.e., polyamide polyphthalamide, polyphenylene sulfide, polyetheretherketones and other polymers) or other synthetic or natural materials. Further a portion of rigid insert 105 may be exposed and interact with the slide and/or the lower portion of a firearm. Rigid insert 105 may also be composed using various materials and combinations of synthetic or natural materials and need not be specifically metal. Moreover, rigid insert 105 may be more rigid than frame 150 though it is possible that both frame 150 and rigid insert 105 may be composed of the same materials. Rigid insert 105 may include distal slide rails 115 A and 115B (115B shown in FIG. 5) that may extend upward from the main part of the frame and may further include bend towards the outside of frame 150. Alternatively, distal slide rails 115A and 115B may include different bends in one or more directions to accommodate a slide or an upper portion of a firearm. Rigid insert 105 may include proximal slide rails 140A and 140B (shown in FIG. 5) that may extend upward from the main part of the frame and may further include a bend towards the outside of frame 150. Alternatively, distal slide rails 115A and 115B may include different bends in one or more directions to accommodate a slide or an upper portion of a firearm. Below distal slide rails 115A and 115B are located distal pin apertures 110A and 110B (shown in FIG. 1, for example). Distal pin apertures 110A and 110B may be used in accommodate a pin. This pin may be an internal pin not extending to the outside of a firearm. Runners 135A and 135B may be connected to a lower plate not enveloped by frame 150. Further, this plate may extend proximally and include proximal apertures 145A and 145B that may be included to reduce weight or may be used to receive a pin connecting the modular firearm control unit 600 to a portion of a firearm.

Rigid insert 105 may include runners 135A and 135B that are located closer to the proximal end of rigid insert 105 than the distal end of rigid insert 105. Runners 135A and 135B may include distinct shapes and sizes. For instance, one side may include a notch where the other does not. One or more portions of runners 135A and 135B may be exposed. Alternatively, runners 135A and 135B may be completely enveloped in frame 150 such that no portion of runners 135A and 135B are exposed. Moreover, bridge 195 of rigid insert 105 may be exposed on the bottom portion of frame 150 opposite distal slide rails 115A and 115B.

Modular firearm control unit 600 may further include slide stop slots 120 A and B. Slide stop slots 120A and 120B extend through both frame 150 (shown in FIG. 5) and rigid insert 105. Slide stop slots 120A and 120B are positioned to accommodate a slide stop that may extend from the left side of frame 150 (shown in FIG. 5) to the right side of frame 150 (shown in FIG. 5). Modular firearm control unit 100 may also include trigger housing apertures 125A and 125B positioned to accommodate a trigger housing pin. The trigger housing pin may extend from a right side of frame 150 through the right and left side of rigid insert 105 and then through the left side of frame 150. Locking block pin aperture 130A and 130B (130B not shown due to view angle) are located above and proximally to housing pin apertures 125A and 125B (125B not shown due to view angle) are positioned to receive a housing pin.

Frame 150 may further include trigger housing aperture 165 that is located on a trigger mechanism housing 160 which is a downward extending portion of frame 150.

Trigger housing apertures 165A and 165B (165B not shown due to view angle) such that an inserted pin may extend from a right side of frame 150 to a left side of frame 150 perpendicularly to the length of frame 150. Frame 150 further includes proximal plate 175 sections off the proximal portion of the trigger mechanism housing 160 and follows the curvature of the proximal portion of the trigger mechanism housing 160. Firearm control unit further displays the outside portion of distal cross brace 190 located below slide rails 115A and 115B.

Modular firearm control unit 600 may further include slide stop slots 120 A and B. Slide stop slots 120A and 120B extend through both frame 150 (shown in FIG. 5) and rigid insert 105. Slide stop slots 120A and 120B are positioned to accommodate a slide stop that may extend from the left side of frame 150 (shown in FIG. 5) to the right side of frame 150 (shown in FIG. 5). Modular firearm control unit 100 may also include trigger housing apertures 125A and 125B positioned to accommodate a trigger housing pin. The trigger housing pin may extend from a right side of frame 150 through the right and left side of rigid insert 105 and then through the left side of frame 150. Locking block pin aperture 130A and 130B (130B not shown due to view angle) are located above and proximally to housing pin apertures 125A and 125B (125B not shown due to view angle) are positioned to receive a housing pin.

Frame 150 may further include trigger housing aperture 165 that is located on a trigger mechanism housing 160 which is a downward extending portion of frame 150. Trigger housing apertures 165A and 165B (165B not shown due to view angle) such that an inserted pin may extend from a right side of frame 150 to a left side of frame 150 perpendicularly to the length of frame 150. Frame 150 further includes proximal plate 175 sections off the proximal portion of the trigger mechanism housing 160 and follows the curvature of the proximal portion of the trigger mechanism housing 160. Firearm control unit further displays the outside portion of distal cross brace 190 located below slide rails 115A and 115B.

Figure 7:
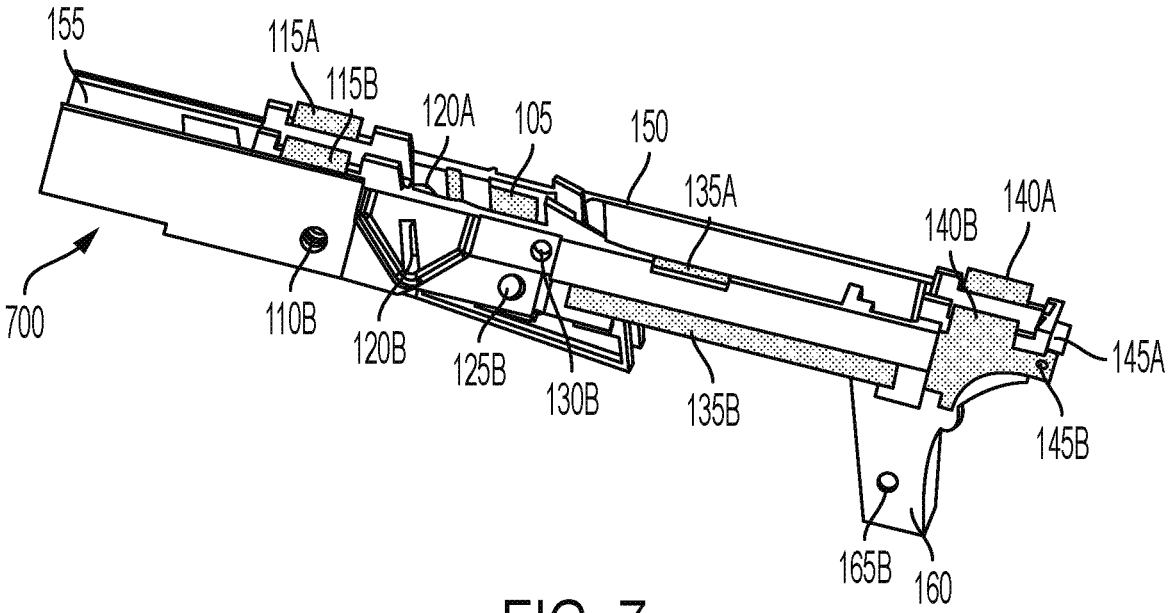
FIG. 7 illustrates a left-sided perspective view of an embodiment of a modular firearm control unit.

FIG. 7 illustrates a left-side view of a modular firearm control unit 700. Modular firearm control unit 700 includes frame 150 that may incorporate rigid insert 105. Frame 150 may envelop rigid insert 105 integrating then rigid insert into the modular frame (e.g., an over mold of rigid insert 105 into frame 150). Frame 150 may be made of various combination of materials that may include metal (i.e., steel, bronze, copper, tin, zinc, metals, metal alloys, and the like according to particular applications), thermoplastics (i.e., polyamide polyphthalamide, polyphenylene sulfide, polyetheretherketones and other polymers) or other synthetic or natural materials. Further a portion of rigid insert 105 may be exposed and interact with a firearm slide and/or the lower portion of a firearm. Rigid insert 105 may also be manufactured using various materials and combinations of synthetic or natural materials and need not be specifically metal. Moreover, rigid insert 105 may be more rigid than frame 150 though it is possible that both frame 150 and rigid insert 105 may be composed of the same materials. Rigid insert 105 may include distal slide rails 115A and 115B that may extend upward from the main part of the frame and may further include bend towards the outside of frame 150. Alternatively, distal slide rails 115A and 115B may include different bends in one or more directions to accommodate a slide or an upper portion of a firearm. Rigid insert 105 may include proximal slide rails 140A and 140B that may extend upward from the main part of the frame and may further include a bend towards the outside of frame 150. Alternatively, proximal slide rails 140A and 140B may include different bends in one or more directions to accommodate a slide or an upper portion of a firearm. Below distal slide rails 115A and 115B is located distal pin apertures 110A (shown in FIG. 2 because of view angle) and 110B. Distal pin apertures 110A and 110B may be used in accommodate a pin. This pin may be an internal pin not extending to the outside of a firearm. Runners 135A and 135B may be connected to a lower plate not enveloped by frame 150. Further, this plate may extend proximally and include proximal apertures 145A and 145B that may be included to reduce weight or may be used to receive a pin connecting the modular firearm control unit 100 to a portion of a firearm.

Rigid insert 105 may include runners 135A and 135B that are located closer to the proximal end of rigid insert 105 than the distal end of rigid insert 105. Runners 135A and 135B may include distinct shapes and sizes. For instance, runner 135B may include a notch where runner 135A may not. Further runners 135A and 135B may be partially exposed, or rather, not completely enveloped by frame 150. Alternatively, runners 135A and 135B may be completely enveloped in frame 150 such that no portion of runners 135A and 135B are exposed.

Modular firearm control unit 700 may further include slide stop slots 120A and 120B. Slide stop slots 120A and 120B extend through both frame 150 and rigid insert 105. Slide stop slots 120A and 120B are positioned to accommodate a slide stop that may extend from the left side of frame 150 to the right side of frame 150. Modular firearm control unit 100 may also include housing apertures 125A and 125B positioned to accommodate a trigger housing pin. The trigger housing pin may extend from a right side of frame 150 through the right and left side of rigid insert 105 and then through the left side of frame 150. Locking block pin aperture 130A and 130B are located above and proximally to housing pin aperture 125A and 125B are positioned to receive a housing pin. Frame 150 includes apertures 125A and 125B on both the left and the right side of the frame 150 allowing a housing pin to extend from one side of frame 150 to another.

Frame 150 may further include trigger housing aperture 165 that is located on a trigger mechanism housing 160 which is a downward extending portion of frame 150. trigger housing aperture 165 may open on a right side of frame 150 and a left side of frame 150 to accommodate a pin that would run perpendicularly to the length of frame 150. Frame 150 further includes recoil spring housing 155 that may include a curved bottom sized to accommodate a recoil spring from a firearm. Distal plate 170 sections off the distal portion of the trigger mechanism housing. Further, distal plate 170 may be shaped to follow the angle of the distal portion of the trigger mechanism housing. At the same time, proximal plate 175 sections off the proximal portion of the trigger mechanism housing 160 and follows the curvature of the proximal portion of the trigger mechanism housing.

Figure 8:
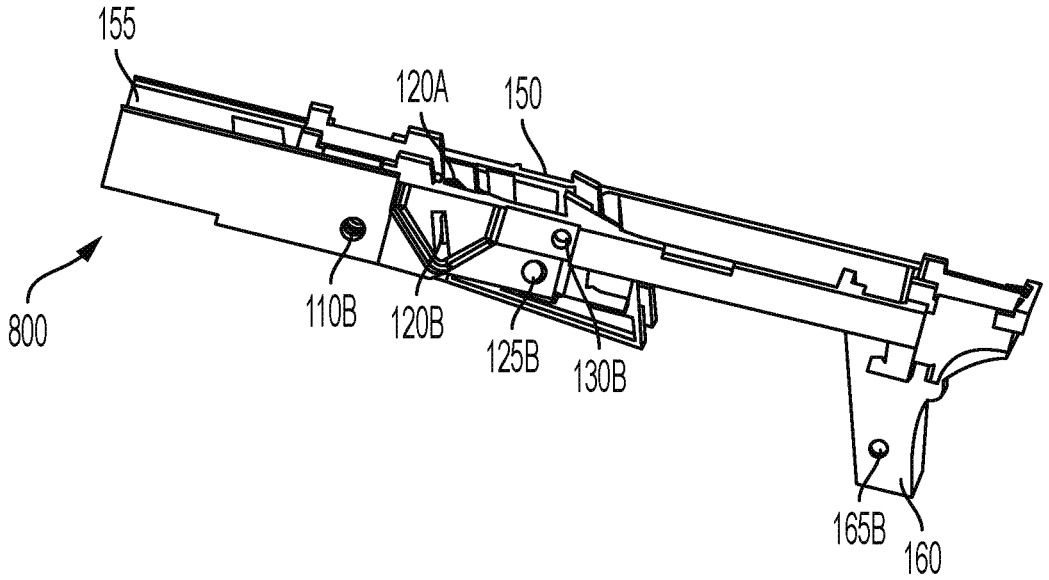
FIG. 8 illustrates a left-sided perspective view of an embodiment of a frame in a modular firearm control unit.

FIG. 8 illustrates a left-sided perspective view of an embodiment of frame 150 in a modular firearm control unit 800. Frame 150 may be made of various combination of materials that may include metal (i.e., steel, bronze, copper, tin, zinc, metals, metal alloys, and the like according to particular applications), thermoplastics (i.e., polyamide polyphthalamide, polyphenylene sulfide, polyetheretherketones and other polymers) or other synthetic or natural materials.

Frame 150 may include slide stop slots 120A and 120B. Slide stop slots 120A and 120B extend through both frame 150 and rigid insert 105. Slide stop slots 120A and 120B are positioned to accommodate a slide stop that may extend from the left side of frame 150 to the right side of frame 150. Modular firearm control unit 100 may also include housing apertures 125A and 125B positioned to accommodate a trigger housing pin. The trigger housing pin may extend from a right side of frame 150 through the right and left side of rigid insert 105 and then through the left side of frame 150. Locking block pin aperture 130A and 130B are located above and proximally to housing pin aperture 125A and 125B are positioned to receive a housing pin. Frame 150 includes an aperture on both the left and the right side of the frame 150 allowing a housing pin to extend from one side of frame 150 to another.

Frame 150 may further include trigger housing aperture 165 that is located on a trigger mechanism housing 160 which is a downward extending portion of frame 150. trigger housing aperture 165 may open on a right side of frame 150 and a left side of frame 150 to accommodate a pin that would run perpendicularly to the length of frame 150. Frame 150 further includes recoil spring housing 155 that may include a curved bottom sized to accommodate a recoil spring from a firearm. Distal plate 170 sections off the distal portion of the trigger mechanism housing. Further, distal plate 170 may be shaped to follow the angle of the distal portion of the trigger mechanism housing. At the same time, proximal plate 175 sections off the proximal portion of the trigger mechanism housing 160 and follows the curvature of the proximal portion of the trigger mechanism housing.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A modular firearm control unit system, comprising:
- a frame comprising;
  - an aperture;
- a rigid insert molded into the frame comprising:
  - a first set of slide rails;
  - a first cross brace positioned directly below the first set of slide rails;
  - an aperture which corresponds with the frame aperture;
- wherein the modular firearm control unit system receives an upper portion of a first firearm and is insertable into a lower portion of a second firearm; and
- wherein the lower portion of the second firearm includes an aperture that corresponds to the frame aperture and the rigid insert aperture.

2. The modular firearm control unit system of claim 1, wherein when the rigid insert is positioned within the frame the aperture of the frame which corresponds with the aperture of the ridged insert together receive a pin.

3. The modular firearm control unit system of claim 1, the frame further comprising: a second aperture.

4. The modular firearm control unit system of claim 3, the rigid insert further comprising: a second aperture compatible with the second aperture of the frame.

5. The modular firearm control unit system of claim 4, wherein the second aperture is a housing aperture.

6. The modular firearm control unit system of claim 5, wherein the second aperture is located on both the right and left side of the frame.

7. The modular firearm control unit system of claim 5, wherein the second aperture is located on both the right and left side of the rigid insert.

8. The modular firearm control unit system of claim 1, the rigid insert further comprising a second set of slide rails.

9. The modular firearm control unit system of claim 8, where in the second set of slide rails are located proximally to the first set of slide rails.

10. The modular firearm control unit system of claim 9, the rigid insert further comprising:
- a second cross brace positioned directly below the second set of slide rails.

11. The modular firearm control unit system of claim 1, the rigid insert further comprising:
- a locking notch.

12. A rigid insert of a modular firearm control unit comprising:
- a first set of slide rails;
- a first cross brace positioned directly below the first set of slide rails;
- an aperture disposed within the rigid insert of the modular firearm control unit which corresponds with a frame aperture in a frame disposed in a lower portion of a firearm; and
- wherein the rigid insert of a modular firearm control unit is molded into the frame and the first set of slide rails are exposed from the frame.

13. The rigid insert of a modular firearm control unit of claim 12, further comprising:
- a second set of slide rails.

14. The rigid insert of modular firearm control unit of claim 13, wherein the second set of slide rails is located proximally to the first set of slide rails.

15. The rigid insert of a modular firearm control unit of claim 13, the rigid insert further comprising:
- a second cross brace.

16. The rigid insert of a modular firearm control unit of claim 15, wherein the second cross brace is located distally to the first cross brace and the second cross brace is positioned directly below the second set of slide rails.

17. The rigid insert of a modular firearm control unit of claim 12, where in the aperture is a distal pin aperture.

18. The rigid insert of a modular firearm control unit of claim 17, wherein the frame disposed in a lower portion of the firearm is compatible with an upper portion of another firearm different from an upper portion of the firearm.

19. The rigid insert of a modular firearm control unit of claim 12, further comprising: a second aperture.

20. The rigid insert of a modular firearm control unit of claim 12, wherein the rigid insert includes slide stop slots.

* * * * *